US009605480B2

(12) United States Patent
Ignova et al.

(10) Patent No.: US 9,605,480 B2
(45) **Date of Patent: *Mar. 28, 2017**

(54) DIRECTIONAL DRILLING CONTROL DEVICES AND METHODS

(71) Applicant: Schlumberger Technology Corporation, Sugar Land, TX (US)

(72) Inventors: Maja Ignova, Cheltenham (GB); Geoffrey C. Downton, Stroud (GB); Dimitrios K. Pirovolou, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 334 days.

This patent is subject to a terminal disclaimer.

(21) Appl. No.: 14/306,223

(22) Filed: Jun. 16, 2014

(65) Prior Publication Data

US 2015/0361725 A1 Dec. 17, 2015

Related U.S. Application Data

(63) Continuation of application No. 12/354,524, filed on Jan. 15, 2009, now Pat. No. 8,783,382.

(51) Int. Cl.

| | |
|---|---|
| ***E21B 7/04*** | (2006.01) |
| ***E21B 44/02*** | (2006.01) |
| ***E21B 47/024*** | (2006.01) |
| ***E21B 47/12*** | (2012.01) |
| ***E21B 47/18*** | (2012.01) |
| ***E21B 49/00*** | (2006.01) |

(52) U.S. Cl.

CPC ..... *E21B 7/04* (2013.01); *E21B 44/02* (2013.01); *E21B 47/024* (2013.01); *E21B 47/122* (2013.01); *E21B 47/18* (2013.01); *E21B 49/003* (2013.01)

(58) Field of Classification Search

CPC ..... E21B 41/0092; E21B 7/04; E21B 43/00; E21B 47/022; E21B 44/02; E21B 47/024; E21B 47/122; E21B 47/18; E21B 49/003

See application file for complete search history.

(56) References Cited

U.S. PATENT DOCUMENTS

| | | | |
|---|---|---|---|
| 6,381,858 | B1 | 5/2002 | Shirasaka |
| 6,464,021 | B1 | 10/2002 | Edwards |
| 6,601,658 | B1 | 8/2003 | Downton |
| 7,136,795 | B2 | 11/2006 | Downton |
| 7,669,669 | B2 | 3/2010 | Downton et al. |

(Continued)

OTHER PUBLICATIONS

Examiner's Report issued in related CA Application No. 2,749,275 mailed Dec. 14, 2015 (4 pages).

*Primary Examiner* — Yong-Suk (Philip) Ro

(57) ABSTRACT

A drill control system includes an uphole control device and a downhole control device. The uphole control device is configured to transmit a reference trajectory to the downhole control device and receive information about an actual trajectory from the downhole control device. The downhole control device is configured to receive the reference trajectory from the uphole control device, measure the actual trajectory, correct deviations between the reference trajectory and the actual trajectory, and transmit information about the actual trajectory to the uphole control device.

20 Claims, 7 Drawing Sheets

(56) References Cited

U.S. PATENT DOCUMENTS

| | | | | |
|---|---|---|---|---|
| 7,751,280 | B2 | 7/2010 | Denichou et al. | |
| 7,957,946 | B2 | 6/2011 | Pirovolou | |
| 8,061,444 | B2 | 11/2011 | Mullins et al. | |
| 8,301,382 | B2 | 10/2012 | Herrera | |
| 8,783,382 | B2 * | 7/2014 | Ignova | E21B 7/04 175/61 |
| 2007/0029112 | A1 | 2/2007 | Li et al. | |
| 2010/0175922 | A1 * | 7/2010 | Ignova | E21B 7/04 175/24 |
| 2010/0185395 | A1 | 7/2010 | Pirovolou et al. | |
| 2011/0213601 | A1 | 9/2011 | Pirovolou | |
| 2012/0046868 | A1 | 2/2012 | Tchakarov et al. | |
| 2013/0126239 | A1 | 5/2013 | Panchal et al. | |

* cited by examiner

DIRECTIONAL DRILLING CONTROL DEVICES AND METHODS

CROSS REFERENCE TO RELATED APPLICATIONS

This is a continuation application of co-pending U.S. patent application Ser. No. 12/354,524, filed on Jan. 15, 2009, and entitled "Directional Drilling Control Devices and Methods," which is hereby incorporated in its entirety for all intents and purposes by this reference.

FIELD OF THE INVENTION

The present invention relates to systems and methods for controlled steering (also known as "directional drilling") within a wellbore.

BACKGROUND OF THE INVENTION

Controlled steering or directional drilling techniques are commonly used in the oil, water, and gas industries to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

SUMMARY OF THE INVENTION

The instant invention provides apparatus and methods for directional drilling. The invention has a number of aspects and embodiments that will be described below.

One embodiment of the invention provides a drill control system including an uphole control device and a downhole control device. The uphole control device is configured to: transmit a reference trajectory to the downhole control device and receive information about an actual trajectory from the downhole control device. The downhole control device is configured to: receive the reference trajectory from the uphole control device, measure the actual trajectory, correct deviations between the reference trajectory and the actual trajectory, and transmit information about the actual trajectory to the uphole control device.

This embodiment can have several features. The downhole control device can transmit drilling performance information to the uphole control device. The drilling performance information can include at least one selected from the group consisting of: rotational speed, rotational acceleration, orientation, inclination, azimuth, build rate, turn rate, and weight on bit. The reference trajectory can be calculated and updated in response to the drilling performance information. The downhole control device can transmit geological information to the uphole control device. The geological information can include at least one selected from the group consisting of: geological properties of formations in front of a bit and geological properties of formations adjacent to the bit. The reference trajectory can be calculated and updated in response to the geological information.

The uphole control device and the downhole control device can communicate with fluid pulses, electrical signals, and/or radio signals. The downhole control device can be in communication with one or more directional steering devices. The downhole control device can correct deviations between the reference trajectory and the actual trajectory more frequently than the downhole control device receives the reference trajectory from the uphole control device. The uphole control device can be in communication with a remote location via satellite.

Another embodiment of the invention provides a drilling method comprising:

providing a drill string having a proximal end and a distal end, providing a downhole control device located within the distal end of the drill string, transmitting a reference trajectory to the downhole control device, utilizing the downhole control device to steer the bit body and the drill string to follow the reference trajectory, periodically receiving information about the actual trajectory from the downhole control device, updating the reference trajectory, and transmitting the updated reference trajectory to the downhole control device. The distal end can include a bit body for boring a hole.

This embodiment can have several features. The step of steering the bit body and drill string can include: measuring an actual trajectory, detecting deviations between the reference trajectory and the actual trajectory, and actuating one or more directional steering devices to correct the deviations. The method can also include receiving drilling performance information from the downhole control device. The method can also include receiving geological information from the downhole control device.

Another embodiment of the invention provides a drilling method including:

receiving a reference trajectory from an uphole control device, measuring an actual trajectory, detecting deviations between the reference trajectory and the actual trajectory, correcting deviations between the reference trajectory and the actual trajectory, and transmitting information about the actual trajectory to the uphole control device.

This embodiment can have several features. The step of correcting deviations can include actuating one or more directional steering devices to correct to the deviations. The method can include transmitting drilling performance information to the uphole control device. The method can include transmitting geological information to the uphole control device.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The invention provides directional drilling devices and methods. More specifically, the invention distributes drilling control between an uphole control device and a downhole control device to provide for more accurate drilling despite the communication challenges presented by drilling environments.

The bit body is adapted for use in a range of drilling operations such as oil, gas, and water drilling. As such, the bit body is designed for incorporation in wellsite systems that are commonly used in the oil, gas, and water industries. An exemplary wellsite system is depicted in FIG. 1.

Wellsite System

Figure 1:
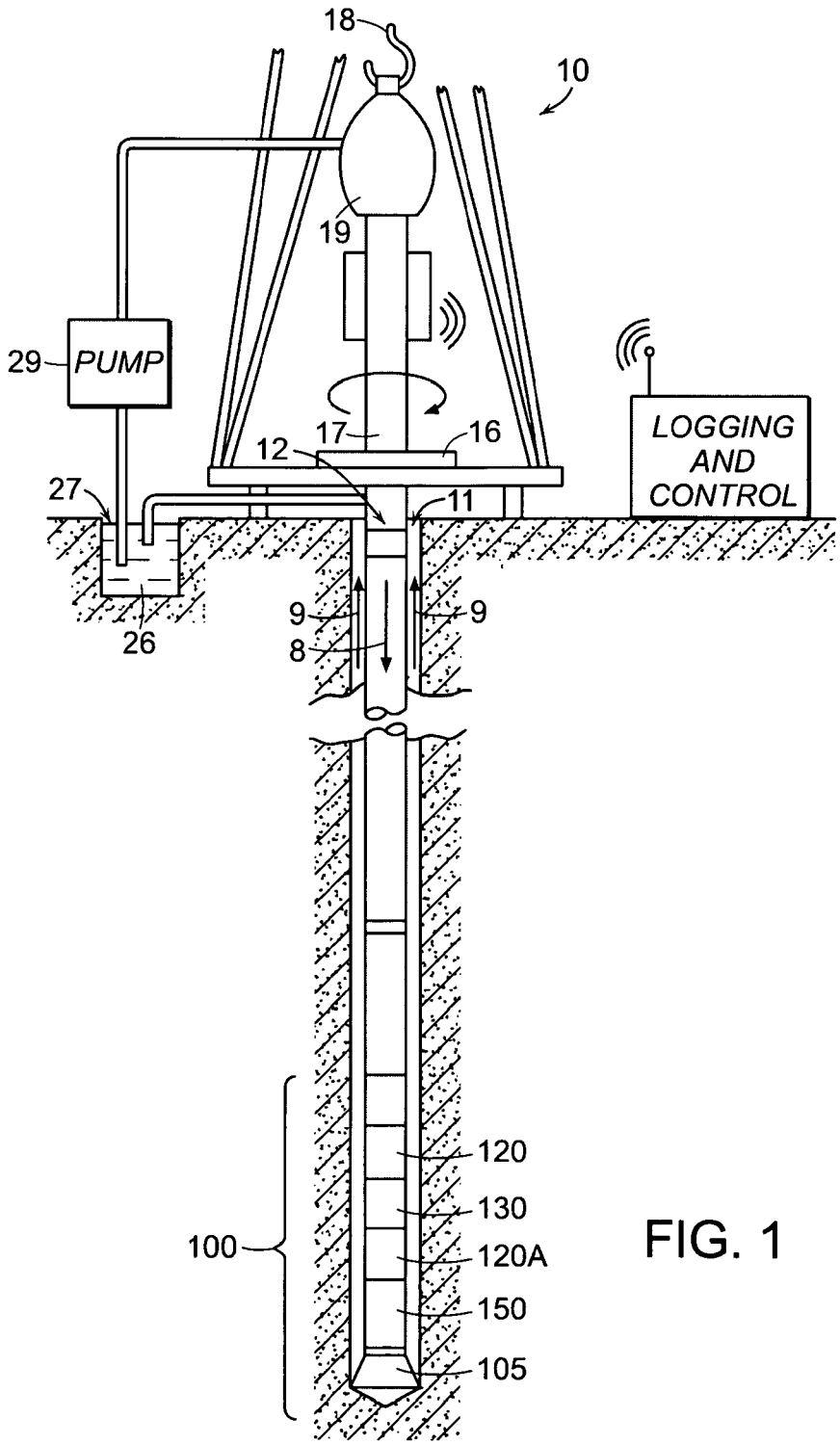
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string 12. The drill string 12 is suspended from a hook 18, attached to a traveling block (also not shown), through the kelly 17 and a rotary swivel 19 which permits rotation of the drill string 12 relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string 12 and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string 12 and drill bit 105. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string 12 so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit 105 will veer off of a planned drilling trajectory because of the unpredictable nature of the formations being penetrated or the varying forces that the drill bit 105 experiences. When such a deviation occurs, a directional drilling system may be used to put the drill bit 105 back on course.

A known method of directional drilling includes the use of a rotary steerable system ("RSS"). In an RSS, the drill string 12 is rotated from the surface, and downhole devices cause the drill bit 105 to drill in the desired direction. Rotating the drill string 12 greatly reduces the occurrences of the drill string 12 getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit 105 is deviated from the local axis of the bottom hole assembly in the general direction of the new hole. The hole is propagated in accordance with the customary three-point geometry defined by upper and lower stabilizer touch points and the drill bit 105. The angle of deviation of the drill bit axis coupled with a finite distance between the drill bit 105 and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit 105 is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit 105 in the desired steering direction. Again, steering is achieved by creating non co-linearity between the drill bit 105 and at least two other touch points. In its idealized form the drill bit 105 is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Control Devices and Methods

Figure 2A:
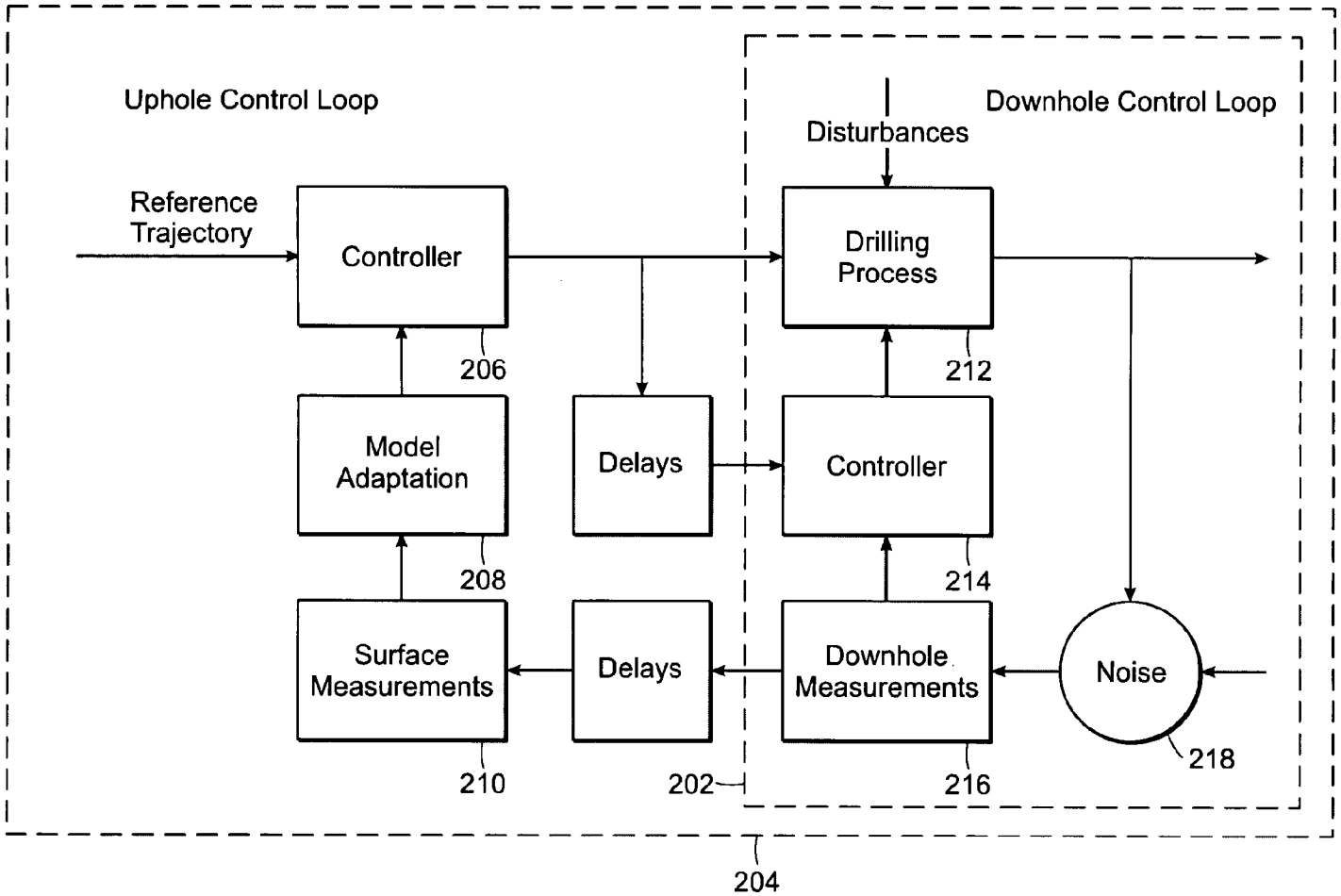
FIG. 2A illustrates a two-level control system for use in conjunction with a wellsite system according to one embodiment of the invention.

Referring to FIG. 2A, a two-level control system for use in conjunction with a wellsite system such as the wellsite system described herein. A downhole control loop 202 automatically adjusts steering commands by comparing a measured trajectory and a reference trajectory. The downhole control loop operates at a fast sampling rate and is nested within an uphole control loop 204. Uphole control loop is characterized by larger sampling intervals than downhole control loop 202 and is responsible for monitoring the performance of the downhole control loop 202 to direct the downhole drilling to a defined target. The controller 206 of uphole control loop 204 makes decisions using model(s) that are adapted in real-time. The adapted model(s) are then used to create new sets of reference trajectories that are sent to the downhole control loop 202.

Additional control loops can be added above, below, or adjacent to the downhole control loop 202 and the uphole control loop 204. For example, an Earth model control loop (not depicted) can monitor the performance of the uphole control loop 204.

The downhole control loop 202 contains an automatic controller 214 that adjusts the drilling process 212 by comparing a measured trajectory 216 and a reference trajectory. The downhole control loop 202 is capable of rejecting most disturbances such as rock formation changes and drill parameter fluctuations as noise 218. Noise 218 can be detected using various known methods and devices known to those of skill in the art.

Figure 2B:
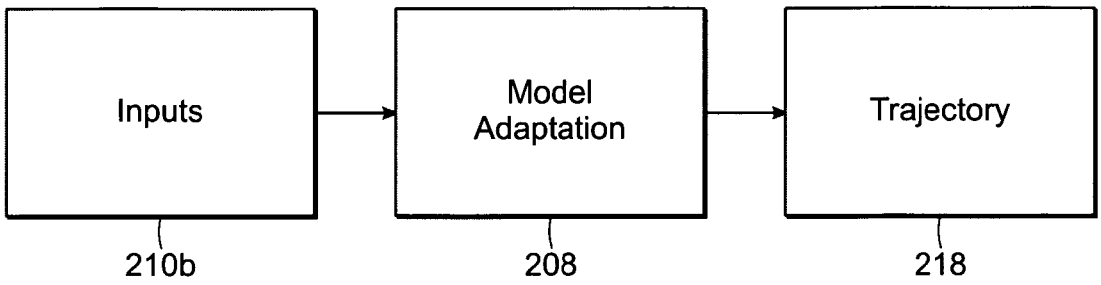
FIG. 2B illustrates the generation and updating of a reference trajectory by an uphole control loop based on a model that is updated in real-time according to one embodiment of the invention.

As depicted in FIG. 2B, the uphole control loop 204 generates and updates a reference trajectory 218 based on a model 208*b* that is updated in real-time. Such updates can include modification of parameters such as initial trajectory, tool force, and formation characteristics. The inputs 210*b* to the model are drilling parameters, steering commands, and bottom hole assembly configuration.

A set of models (e.g., finite-element models of the bottom hole assembly and a range of empirical and semi-empirical models) can be used. The selection of a model can be based on past and present performance of the model (i.e., the deviation between the real data and the model).

Once updated, the model 208 is used to calculate a set of new reference trajectories (future inputs) 218 that are sent to the downhole control loop 202. The number of set-points that reflect the amplitude and the duration of each set-point change and the correction that has to be adjusted over a specific measured depth scale can be defined by the driller or automatically selected by the system 200.

The uphole control loop 204 can also transmit other instructions in addition to trajectory. For example, the uphole control loop 204 can also control the rotational speed of the drill bit, either by controlling the rotational speed of the drill string or by controlling speed of an independently power drill bit (e.g. a drill bit powered by a mud motor).

Figures 3A, 3B:
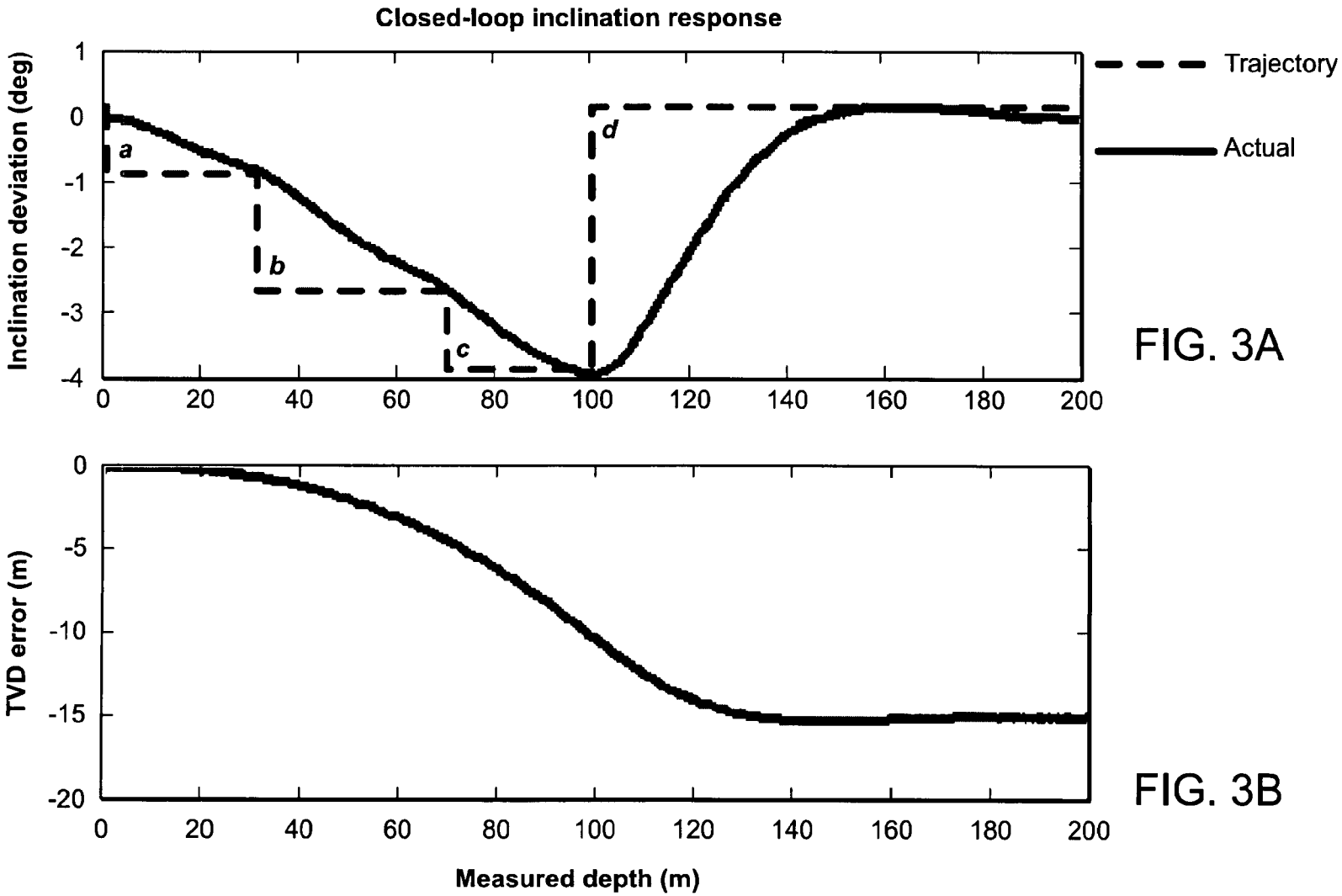
FIGS. 3A and 3B depict an example of correction of the true vertical depth (TVD) for −15 meters over 140 meters measured depth using four set-point changes according to one embodiment of the invention.

FIG. 3A depicts an example of correction of the true vertical depth (TVD) for −15 meters over 140 meters measured depth using four set-point changes. At point a, uphole control loop 204 sends a command to downhole control loop 202 to follow a trajectory having an angle of −1 degree relative to horizontal. Downhole control loop 202 pursues this trajectory and converges on an inclination of −1 degree. At point b, uphole control loop 204 sends a command to downhole control loop 202 to follow a trajectory having an angle of −2.75 degrees relative to horizontal. Again, downhole control loop 202 pursues this trajectory and converges on an inclination of −2.75 degrees. At point c, uphole control loop 204 sends a command to downhole control loop 202 to follow a trajectory having an angle of −4 degrees relative to horizontal. Downhole control loop 202 pursues this trajectory and converges on an inclination of −4 degrees. A point d, uphole control loop 204 detects and/or anticipates that the drill bit has reached the desired TVD deviation of −15 meters and sends a command to downhole control loop 202 to follow a trajectory having an angle of 0 degrees relative to horizontal. Again, downhole control loop 202 pursues this trajectory and converges on an inclination of 0 degrees. The result of these communications in terms of TVD deviation is depicted in FIG. 3B.

Drilling instructions can be computed automatically by the uphole control loop 204 based on a pre-defined goal or based on a computer determined goal, such as a goal generated with artificial intelligence software. At any point in the control loop, a user can monitor the drilling progress and/or instruction and intervene if desired or necessary.

Downhole control loop 202 and uphole control loop 204 can communicate via a variety of communication technologies using a variety of known devices. Such devices include, for example, radio devices operating over the Extremely Low Frequency (ELF), Super Low Frequency (SLF), Ultra Low Frequency (ULF), Very Low Frequency (VLF), Low Frequency (LF), Medium Frequency (MF), High Frequency (HF), or Very High Frequency (VHF) ranges; microwave devices operating over the Ultra High Frequency (UHF), Super High Frequency (SHF), or Extremely High Frequency (EHF) ranges; infrared devices operating over the far-infrared, mid-infrared, or near-infrared ranges; a visible light device, an ultraviolet device, an X-ray device, and a gamma ray device.

Downhole control loop 202 and uphole control loop 204 can additionally or alternatively transmit and/or receive data by acoustic or ultrasound waves, or by via a sequence of pulses in the drilling fluid (e.g. mud). Mud communication systems are described in U.S. Pat. Nos. 4,866,680; 5,079,750; 5,113,379; 5,150,333; 5,182,730; 6,421,298; 6,714,138; and 6,909,667; and U.S. Patent Publication No. 2005/0028522; and 2006/0131030. Suitable systems are available under the POWERPULSE™ trademark from Schlumberger Technology Corporation of Sugar Land, Tex. In another embodiment, the metal of the drill string 12 (e.g. steel) can be used as a conduit for communications.

In another embodiment, communication between the downhole control loop 202 and uphole control loop 204 is facilitated by a series of relays located along the drill string 12 as described in U.S. patent application Ser. No. 12/325,499, filed on Dec. 1, 2008.

Downhole control loop 202 and uphole control loop 204 can be implemented in various known hardware and software devices such as microcontrollers or general purpose computers containing software that affects the algorithms described herein. The devices implementing downhole control loop 202 and uphole control loop 204 can be place in any location relative to the wellbore. For example, the device implementing the downhole control loop 202 can be located in the bottom hole assembly and/or the drill bit, while the uphole control loop is located above-ground. In another embodiment, each repeater along the drill string can include a control loop implementing device to compensate for the inevitable data transmission delays as instructions and data are transmitted.

Figure 4A:
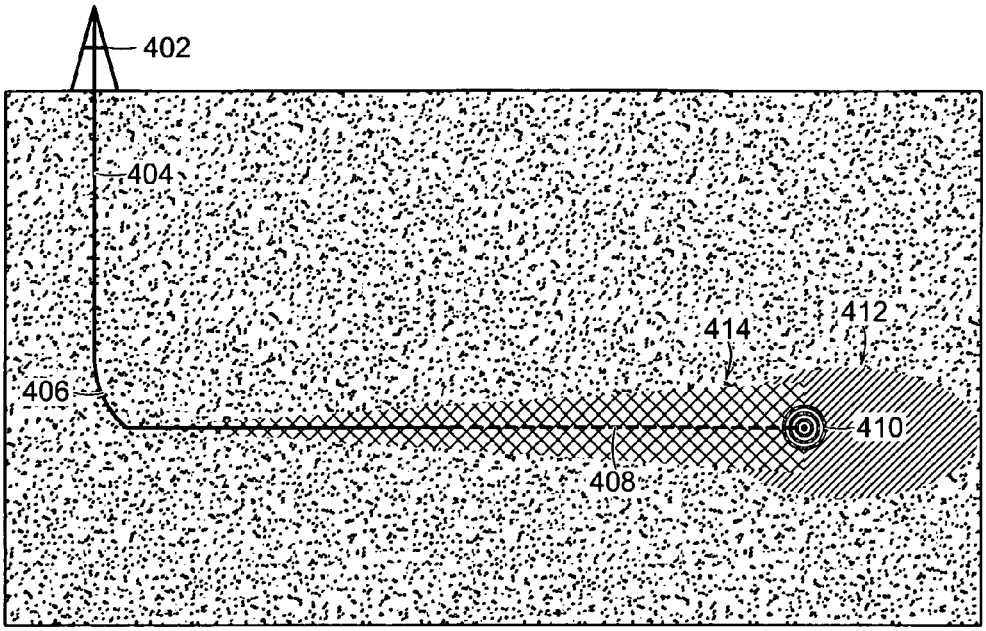
FIGS. 4A and 4B illustrate the calculation of a confidence interval for a target trajectory according to one embodiment of the invention.
Figure 4B:
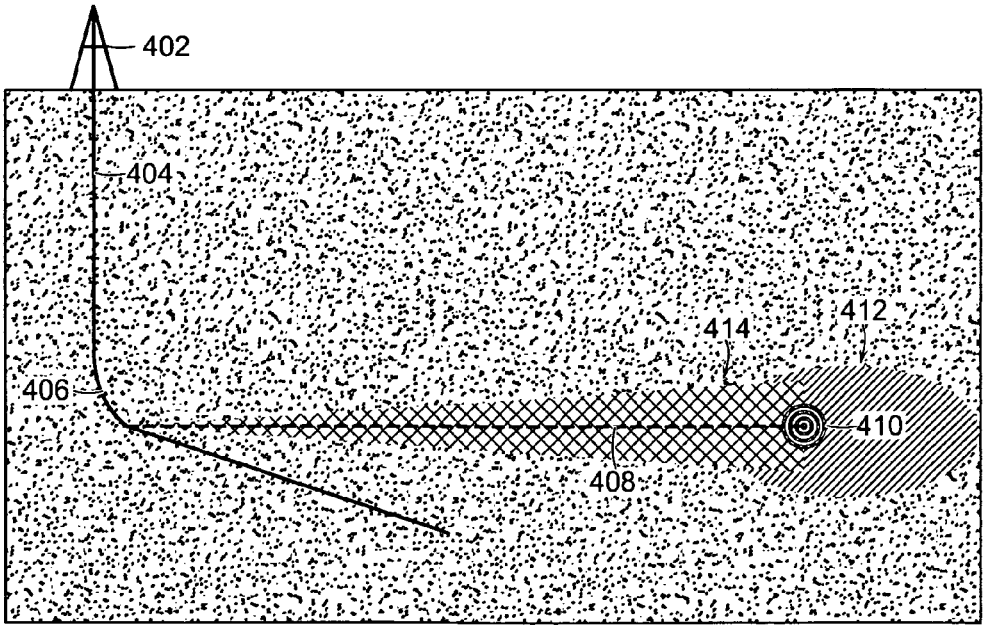

Referring to FIGS. 4A and 4B, downhole control loop 202 and/or uphole control loop 204 can calculate a confidence interval for the target trajectory. A wellsite system 402 is provided including a drill string 404. After drilling a vertical hole, the drill string 404 makes a slight dogleg 406. The drill string trajectory 408 (illustrated by a dashed line) then calls for the drill string to drill a horizontal hole to reach target 410 (e.g. within an oil, gas, or water reservoir 412). The downhole control loop 202 and/or uphole control loop 204 calculates a confidence interval 414 (illustrated by cross-hatching).

In FIG. 4A, drill string 404 follows the trajectory 408 and does not follow a path that exceed the confidence interval 414. In FIG. 4B, the drill string 404 deviates from trajectory 408 and exceeds the confidence interval 414. This deviation can be caused by a variety of reasons such unexpected geological formations or broken drilling equipment (e.g. a broken steering device).

The confidence interval 414 allows downhole control loop 202 and/or uphole control loop 204 to discount minor variation from trajectory 408 that may be caused by communication delays, geological variations, and the like. Also the confidence interval 414 is a depicted as a two-dimensional cone, confidence intervals in various embodiments of invention can also use three-dimensional confidence intervals defined by the Euclidean distance from the trajectory 408. Additionally, the width of the confidence interval 414 need not grow linearly as depicted in FIGS. 4A and 4B. Rather, confidence interval 414 can vary in shape and width. For example, the confidence interval 414 can be wider when the drill string is exiting a turn as a greater deviation from a trajectory can be expected during such a maneuver. Conversely, the confidence interval 414 can be smaller when the drill string is following a substantially straight trajectory. Likewise, various geological formations can produce varying levels of expected deviation, which can be used to construct appropriate confidence intervals 414.

Downhole control loop 202 and/or uphole control loop 204 can be configured to take various actions upon detecting that that an actual drill string trajectory has deviated from the desired trajectory 408 by a distance that exceeds confidence interval 414. Depending on the degree of the deviation, the distance to the target, the geological properties of the formation, and the like, the downhole control loop 202 and/or uphole control loop 204 can transmit a new trajectory based on the current position of the drill bit, cease drilling, trigger an alarm or an exception, and the like.

Figure 5:
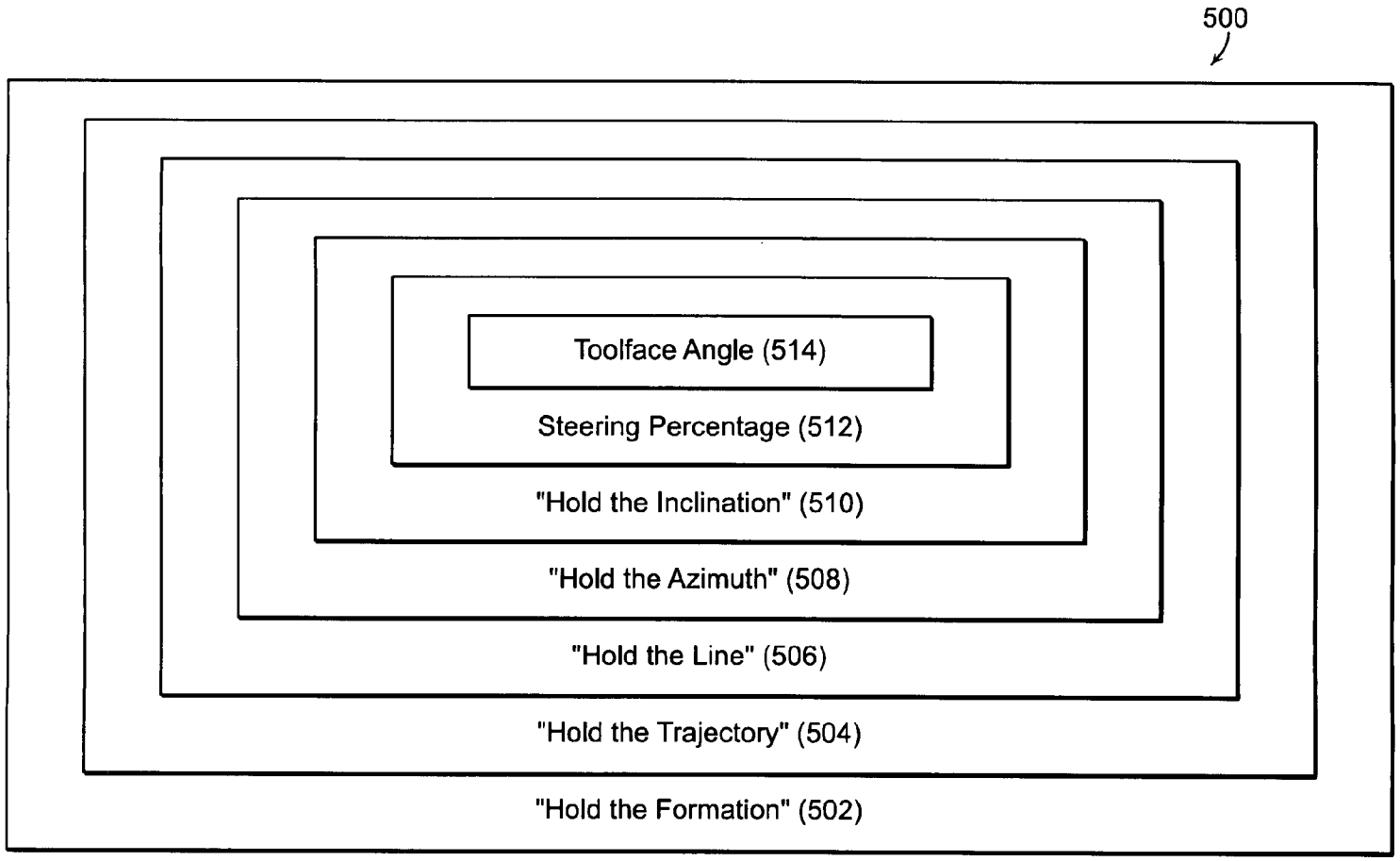
FIG. 5 depicts a multi-level nested drilling control system according to one embodiment of the invention.
Figure 6:
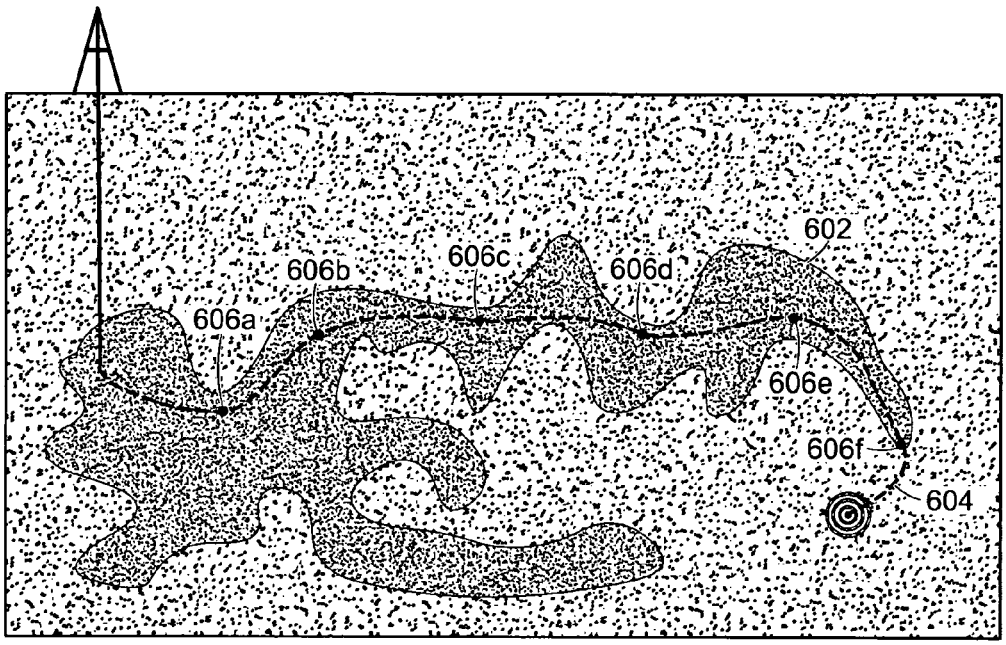
FIG. 6 depicts the operation of multi-level nested drilling control system according to one embodiment of the invention.

Referring to FIG. 5, which is explained in the context of FIG. 6, the invention herein can be further extended to provide a multi-level nested drilling control system 500. The outermost loop 502 seeks to drill a borehole that stays within a particular geological formation 602. Such a borehole may be desired if a formation has a particular property such as porosity or permeability. Moreover, drilling a borehole within a low number of formations can limit the number of cements required to form casings.

Loop 502 communicates with loop 504, which maintains a trajectory 604. As understood by one of skill in the art, a trajectory is a curve that passes through all desired points 606*a-f* (e.g. points within the formation 602 specified by loop 502).

Loop 504 communicates with loop 506, which maintains a line. The trajectory set 25 by loop 504 can be decomposed into a series of lines (e.g. lines tangential to trajectory 604 or lines connecting points 606*a-f*), the adherence to which is controlled by loop 506.

Any three dimensional line can be decomposed into a starting point, azimuth, and inclination as described by the following parametric equations:

$$x=x.\text{sub}.o=\cos(A)t$$

$$y=y.\text{sub}.o=\sin(A)t$$

$$z=z.\text{sub}.o=\sin(I)t$$

wherein x, y, and z are all function of the independent variable t; x.sub.0, y.sub.0, and z.sub.0 are the initial values of each respective variable (i.e. the starting point); A is the azimuth with respect to a plane extending through the x and z planes; and I is the inclination with regard to the x and y planes.

Loop 506 communicates with loop 508, which maintains an azimuth. Loop 508 communications with loop 510, which maintains the inclination.

Loop 510 communicates with loop 512, which maintains a steering percentage—a degree of actuation of one or more steering devices on the drill string, bottom hole assembly, and/or drill bit.

Loop 512 communicates with loop 514 to maintain a toolface angle with respect to a drill string axis, borehole axis, and/or borehole face.

By utilizing a multi-loop control approach, computation can be shared by various software and/or hardware components that can be located at various points throughout the drill string. In some embodiments, less communication is generally required between the outer loops. Moreover, the use of a multi-loop control approach achieves for high coherence within each control loop and low coupling between loops. These desired attributes allow for increased flexibility in configuring the control system and assembling a drill string with various components, as the outer loops (e.g. loop 502) need not be aware of the steering device(s) controlled by loop 512.

INCORPORATION BY REFERENCE

All patents, published patent applications, and other references disclosed herein are hereby expressly incorporated by reference in their entireties by reference.

Those skilled in the art will recognize, or be able to ascertain using no more than routine experimentation, many equivalents of the specific embodiments of the invention described herein. Such equivalents are intended to be encompassed by the following claims.

What is claimed is:

1. A drill control system comprising:
an uphole control device; and
a downhole control device;
wherein the uphole control device is configured to:
transmit a reference trajectory to the downhole control device;
receive information about an actual trajectory from the downhole control device; and
transmit control signals to the downhole control device to control rotational speed of a drill bit based on information received from the downhole control device;
and wherein the downhole control device is configured to:
receive the reference trajectory from the uphole control device;
correct deviations between the reference trajectory and the actual trajectory; and
transmit information about the actual trajectory to the uphole control device, wherein the uphole control device implements an uphole control loop and the downhole control device implements a downhole control loop, the uphole control loop having larger sampling intervals than the downhole control loop while monitoring the performance of the downhole control loop to facilitate drilling to a defined target.

2. The drill control system of claim 1, wherein the downhole control device transmits drilling performance information to the uphole control device.

3. The drill control system of claim 2, wherein the drilling performance information includes rotational speed, orientation, and inclination.

4. The drill control system of claim 2, wherein the reference trajectory is calculated and updated in response to the drilling performance information.

5. The drill control system of claim 1, wherein the downhole control device transmits geological information to the uphole control device.

6. The drill control system of claim 5, wherein the reference trajectory is calculated and updated in response to the geological information.

7. The drill control system of claim 1, wherein the uphole control device and the downhole control device communicate with fluid pulses.

8. The drill control system of claim 1, wherein the uphole control device and the downhole control device communicate with electrical signals.

9. The drill control system of claim 1, wherein the uphole control device and the downhole control device communicate with radio signals.

10. The drill control system of claim 1, wherein the downhole control device is in communication with one or more directional steering devices.

11. The drill control system of claim 1, wherein the downhole control device corrects deviations between the reference trajectory and the actual trajectory more frequently than the downhole control device receives the reference trajectory from the uphole control device.

12. The drill control system of claim 1, wherein the uphole control device is in communication with a remote location via satellite.

13. A drilling method comprising:
providing a drill string having a proximal end and a distal end, the distal end having a bit body for boring a hole;
providing a downhole control device located within the distal end of the drill string;
employing an uphole control loop to transmit a reference trajectory to the downhole control device;
utilizing a downhole control loop on the downhole control device to:
measure an actual trajectory;
employ a plurality of changes to steer the bit body and the drill string to correct deviations between the reference trajectory and the actual trajectory; and
periodically provide information about the actual trajectory to the uphole control loop;
using the uphole control loop to:
update the reference trajectory; and
transmit the updated reference trajectory to the downhole control device; and
taking larger sampling intervals with the uphole control loop compared to the downhole control loop.

14. The drilling method of claim 13, further comprising actuating one or more directional steering devices to correct the deviations.

15. The drilling method of claim 13, further comprising using the downhole control loop to reject certain disturbances as noise.

16. The drilling method of claim 13, further comprising using the downhole control loop to transmit geological information uphole.

17. A drilling method comprising:
receiving a reference trajectory from an uphole control device employing an uphole control loop;
calculating a confidence interval for the reference trajectory;
measuring an actual trajectory;
detecting deviations between the reference trajectory and the actual trajectory;
correcting deviations between the reference trajectory and the actual trajectory exceeding the confidence interval;
transmitting information about the actual trajectory to the uphole control device;
using an automatic controller of a downhole control loop to adjust the drilling by comparing the actual trajectory to the reference trajectory; and
using the uphole control device to monitor the downhole control loop and to further control drilling parameters in real-time in addition to controlling the actual trajectory in real-time based on the information transmitted from downhole.

18. The drilling method of claim 17, wherein correcting deviations includes actuating one or more directional steering devices to correct to the deviations.

19. The drilling method of claim 17, further comprising transmitting drilling performance information to the uphole control device.

20. The drilling method of claim 17, further comprising transmitting geological information to the uphole control device.

* * * * *